US006622959B2

(12) United States Patent
Robitaille

(10) Patent No.: US 6,622,959 B2
(45) Date of Patent: Sep. 23, 2003

(54) OPEN CLIP AUTOMATIC SPLICING SYSTEM FOR HOT MELT COATED TAPE ROLLS AND METHOD OF USING SAME

(75) Inventor: Martin Robitaille, 100, rue de Naples, St-Augustin-de-Desmaures Quebec (CA), G3A 2Y2

(73) Assignee: Martin Robitaille, St-Augustin-de-Desmaures (CA)

( * ) Notice: Subject to any disclaimer, the term of this patent is extended or adjusted under 35 U.S.C. 154(b) by 82 days.

(21) Appl. No.: 09/943,139

(22) Filed: Aug. 31, 2001

(65) Prior Publication Data

US 2003/0042351 A1 Mar. 6, 2003

(51) Int. Cl.[7] ..... B65H 19/18; B31F 5/00
(52) U.S. Cl. ..... 242/556; 24/31 L; 156/502
(58) Field of Search ..... 242/551, 553, 242/556, 332.4; 226/92; 156/157, 502, 504; 493/381; 24/31 L, 38, 31 F, 168

(56) References Cited

U.S. PATENT DOCUMENTS 1,655,297 A * 1/1928 Thornton ..... 226/92
2,433,446 A * 12/1947 Foster ..... 156/502
3,741,079 A * 6/1973 Bossons et al. ..... 156/502
4,917,327 A * 4/1990 Asbury et al. ..... 242/555
5,029,768 A * 7/1991 Asbury et al. ..... 242/556
5,740,983 A * 4/1998 Earle et al. ..... 242/556
5,989,792 A * 11/1999 Miyai ..... 242/556
6,223,962 B1 * 5/2001 Pimpis ..... 242/332.4

FOREIGN PATENT DOCUMENTS

CA 2081713 4/1993

* cited by examiner

*Primary Examiner*—John M. Jillions
(74) *Attorney, Agent, or Firm*—Robert Brouillette; Ronald S. Kosie; Gaetan Prince

(57) ABSTRACT

An apparatus and method to auto-splice tapes in a tape dispensing machine where a continuous supply of tape is required. When a new roll of tape needs to be provided, a splicing apparatus or technique must permit to securely and efficiently make the connection between the first roll of tape and the new tape. The apparatus and method provide an open clip which engages one extremity of a running tape and one extremity of a stationary stand-by tape.

22 Claims, 6 Drawing Sheets

OPEN CLIP AUTOMATIC SPLICING SYSTEM FOR HOT MELT COATED TAPE ROLLS AND METHOD OF USING SAME

BACKGROUND OF THE INVENTION

1. Field of the Invention

The present invention concerns the automatic splicing of a stationary roll of hot melt coated tape to an unwinding roll, by using an open clip.

2. Description of the Prior Art

Reinforcing tapes or tear tapes are often used in the construction of modern packaging. To introduce these tapes into the manufacture of cardboard, different types of dispensers have been developed over the years. Lately, to obtain the necessary efficiency dictated by today's industrial equipments, different automatic splicing systems have been developed. Some of these systems use double coated pressure sensitive adhesive tapes (Canadian Patent Application #2,081,713) or mechanical systems with closed loops (U.S. Pat. Nos. 4,917,327 and 5,029,768). Even if these systems are more advanced than the previous manual systems, they still have important drawbacks.

One the most important disadvantage of these systems is the level of operator involvement that is required. When a new roll of tape is installed on the dispenser, the operator must tie the mechanical linkage used for the automatic splicing system. To do this, the operator must use the tie that is present at the leading end of the new roll of tape and create a closed passageway (loop) around the unwinding tape. An obstacle, extending transversely across and beyond the width of the tape, is present at the trailing end of the tape in operation. This obstacle cannot pass through the closed passageway (loop). When the first roll of tape is depleted, the obstacle will connect with the loop, connecting the tape from the first roll to the tape of the second roll, thus starting said roll.

Usually, the closed passageway is made by using a small cord which is fixed at the leading end of the new roll of tape. The operator brings the leading end of the new roll of tape to start at the specific position, and he ties the cord around the tape in operation. The quality of the knot is quite important. If the knot is too loose, the obstacle at the trailing end of the tape in operation will go through the tied cord, and the splicing will fail. If the knot is too tight, it is quite probable that the passageway will be too small. The cord will then be in tight contact with the edges of the running tape and the friction will then cut the splicing cord, the result of which will be the failure of the splice.

It is quite evident that this operation is labour intensive and demands a level of manual dexterity that cannot be obtained without some training. Furthermore, the tying of a knot around a tape that is running at more than 600 feet per minute can raise safety issues. There are risks that the operator can cut his fingers around the edges of the running tape or get his finger caught in the passageway, under the knot.

The time necessary for the operation is also a major drawback of this system. The operator might need as much as 30 seconds to do all the steps involved. These seconds, on top of the time needed to install a roll on the dispenser, will result in the fact that an operator might have to spend 100% of his time doing these operations.

Another system used in similar applications uses double sided pressure sensitive adhesive tape. With this tape, we can mechanically tie two pieces of materials when they are stationary and properly positioned. To do this, a sophisticated piece of equipment is required as the stationary piece of material must be positioned precisely, the running material must be stopped momentarily without slowing down the process, the two pieces of materials must be put together so the adhesive bond can be accomplished, both materials must be reaccelerated and the excess piece of material must be cut off.

This type of system is efficient in applications where the rolls to be spliced are quite large, since the equipment needed also tends to be large. In the case of hot melt coated reinforcing or tear tapes, this type of system is unattractive because of the smaller size of the rolls and the limited amount of space available to install the tape dispenser close to the cardboard manufacturing equipments. Also the existing systems can not make the splice at the full speed of the cardboard manufacturing equipment, which is a major drawback.

It is the object of this invention to fulfill these and other needs.

BRIEF SUMMARY OF THE INVENTION

According to one embodiment of this invention, a roll of tape is supplied with an element, positioned at the trailing end of a roll, another element is positioned at the leading end of another roll, both elements not cooperating with each other, and a third element is installed around both tapes, this third element linking both end elements together. For example, a roll of tape can be supplied with a rigid flat piece of tape at the trailing end, this piece not exceeding the width of the tape, and another roll is supplied with a rigid piece of tape at the leading end, both the leading end and the trailing end not cooperating with each other, and an open clip is also supplied with both tape rolls. Once the rolls are installed on the tape dispenser, and one roll is running, the stand-by tape is brought close to the running tape, and the operator can easily insert the tapes inside the clip through the open passageway of the clip with no particular manual involvement or dexterity, and in less than 2 seconds. Once the running tape has run out, the trailing end catches the clip which in turn catches the leading end of the other roll of tape, thus making the tapes self splicing. This invention reduces the amount of labour involved and the dexterity needed to assure the success of the splicing mechanism. It also reduces the safety hazards compared with the existing systems.

In another aspect there is provided a clip for use in a tape dispensing machine said machine comprising a running tape having first engagement means at its first extremity and second engagement means at its second extremity and means to hold, in stand-by relationship to said running tape, a stand-by tape having third engagement means at its first extremity and fourth engagement means at its second extremity said clip having a perimeter defining an open area adapted to surround said running tape and said stand-by tape, an opening in said perimeter through which said running tape and said stand-by tape can be introduced in said open area and means to engage with said second engagement means and said third engagement means.

In a further aspect there is provided a splicing apparatus for a tape dispensing machine comprising:

a) a running tape having first engagement means at its extremities, b) a stand-by tape, having second engagement means at its extremities, said stand-by tape being located adjacent to said running tape, c) a clip having an opening to a generally enclosed open portion, said open portion having a running side and a replacement side, whereby said running tape and said stand-by tape are spliced together by said clip with one of said first engagement means of said running tape being connected to said running side of said clip and one of said second engagement means of said stand-by tape being connected to said replacement side of said clip.

In a still further aspect there is provided a method for splicing tapes in a tape dispensing machine where one of the tapes is in movement to ensure a continuous supply of tape, comprising the steps of:

a) providing a first running tape with a running direction and first engagement means at its extremities;

b) positioning a second immobile stand-by tape with a replacement direction and second engagement means at its extremities, said second tape being adjacent to said first tape and said replacement direction being generally parallel to said running direction;

c) inserting said first and second tape into a generally enclosed open portion of a clip having an opening;

d) having one of said first engagement means of said first running tape connect and drag along said clip, e) having said clip connect with one of said second engagement means of said second tape and drag it along.

According to another embodiment of this invention, we have a flat clip, supplied apart from the rolls of tape, which possesses a small opening that stays open, through which the tape in operation and the stand-by tape can be inserted and positioned, so the rigid piece of tape at the trailing end of the running tape connects and carries the clip with it, the clip then connecting with the rigid piece of tape at the leading end of the roll of tape to start, thus connecting both tapes together.

According to still another embodiment, this invention is supplied with a flat open clip, said clip supplied apart from the rolls of tape and having a permanent opening to access the inside area, a roll of tape is supplied with a rigid piece of tape positioned at the trailing end, this piece not extending beyond the width of the tape and the tape being progressively reduced in width from about 25 mm from the rigid piece, to become a cord at the rigid piece itself, and a roll of tape supplied with a rigid piece of tape at the leading end, this piece of rigid tape being larger than the width of the tape. The clip is installed by the operator by using the permanent opening and feeding both tapes through this passageway to position them inside the clip with the stand-by tape between the running tape and the permanent opening, thus preventing the running tape, the cord and piece of rigid tape at the trailing end of the running tape to escape from the open passageway of the clip. The rigid piece of tape at the trailing end of the running tape then connects with the clip, which in turns connects with the rigid piece of tape at the leading end of the roll of tape to start, thus connecting both tapes together, making the tapes self splicing.

According to still another embodiment, this invention is supplied with a flat open clip, the clip having an inside hole and a permanent opening from the inside hole to the outside of the clip. One end of the clip is pointed and extends towards the outside of the clip for both the outside edge as well as the inside hole, while the other end is square for the outside edge and the inside hole, with a permanent opening from the center of the outside edge leading to the inside hole. The clip can be made of many materials and is supplied apart from both rolls of tape. A roll of tape is supplied with an element at the trailing end, the element being a rigid piece of tape or a piece of cardboard with the tape folded over the piece and adhered to itself, the rigid piece of tape or cardboard being the same width as the tape, and the tape being progressively reduced in width from about 25 mm of the rigid piece, to become a cord at the rigid piece itself, and a roll of tape having at the leading end a rigid piece of tape or a piece of cardboard with the tape folded over the piece and adhered to itself, the rigid piece of tape or the piece of cardboard being wider than the tape. Both rolls of tape are installed on a tape dispenser, and when needed both tapes are brought together, one on top of the other. Both tapes are fed in through the clip by the permanent opening, with the stand-by tape between the permanent opening and the running tape. When the running tape is exhausted, the reduced width section prior to the rigid piece of tape or cardboard will help the tape and then the cord move to the pointed edge of the inside edge of the clip, thus securing the rigid piece of tape or cardboard to the center of the clip. The clip is then locked to the trailing end of the running tape, which carries it in its stead. The clip then connects with the rigid piece of tape or cardboard at the leading end of the new roll of tape to start. The rigid part of tape locks with the flat edge of the inside hole of the clip, and being rigid it can not go through the permanent opening of the clip. The clip is then locked to the leading end of the new roll of tape to start, thus locking both rolls of tape together, making them self splicing.

The preceding embodiments and the advantages of the present invention will be more apparent from the following detailed description, which proceeds with reference to the accompanying drawings.

DETAILED DESCRIPTION OF THE INVENTION

Figure 1:
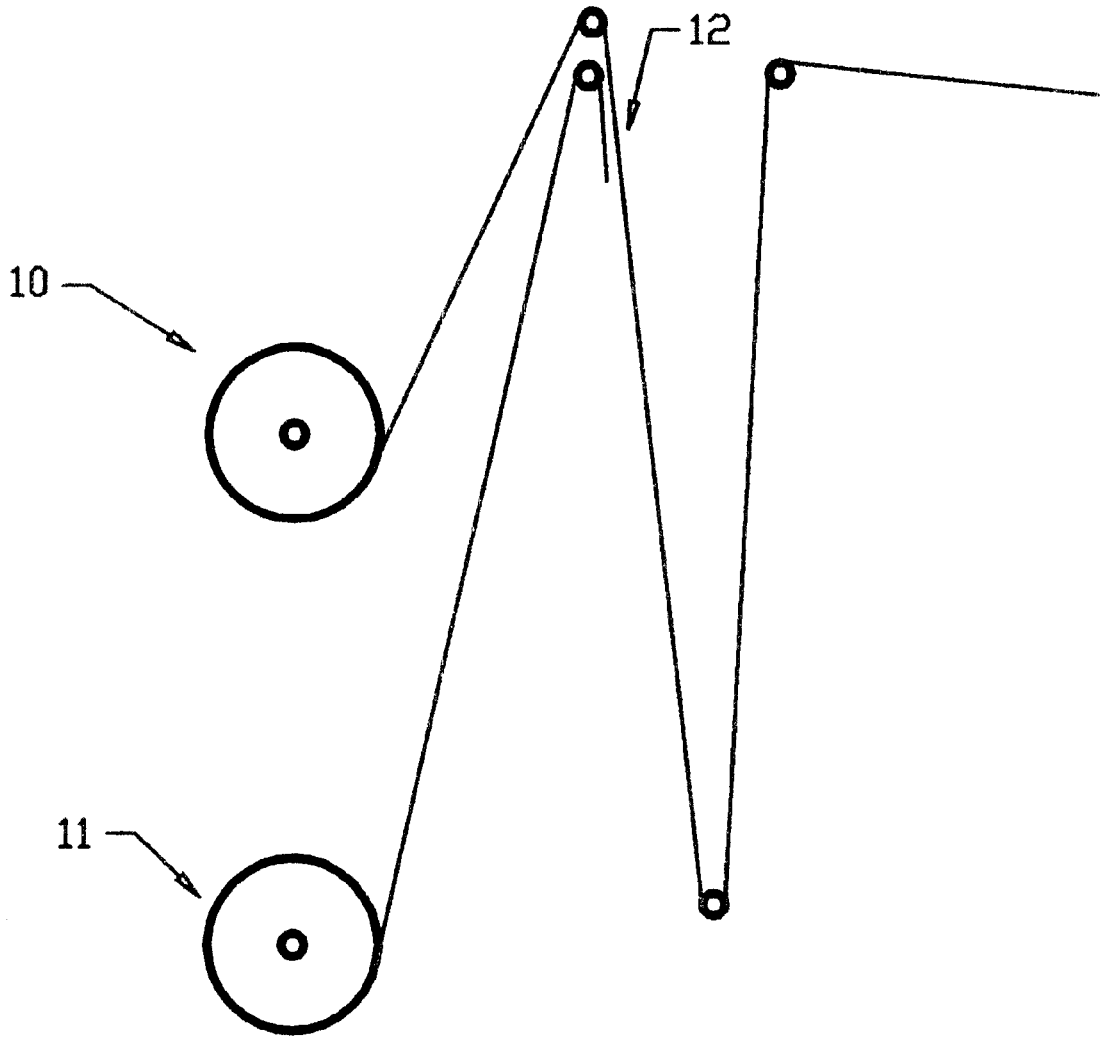
FIG. 1 shows an apparatus to dispense the running tape and the stand-by tape, with a means to bring both tapes together, one on top of the other.

Looking first at FIG. 1, we see an apparatus to dispense one roll of tape 10 and one stand-by roll of tape 11 providing a means to hold both tapes together one on top of the other 12.

Figure 2:
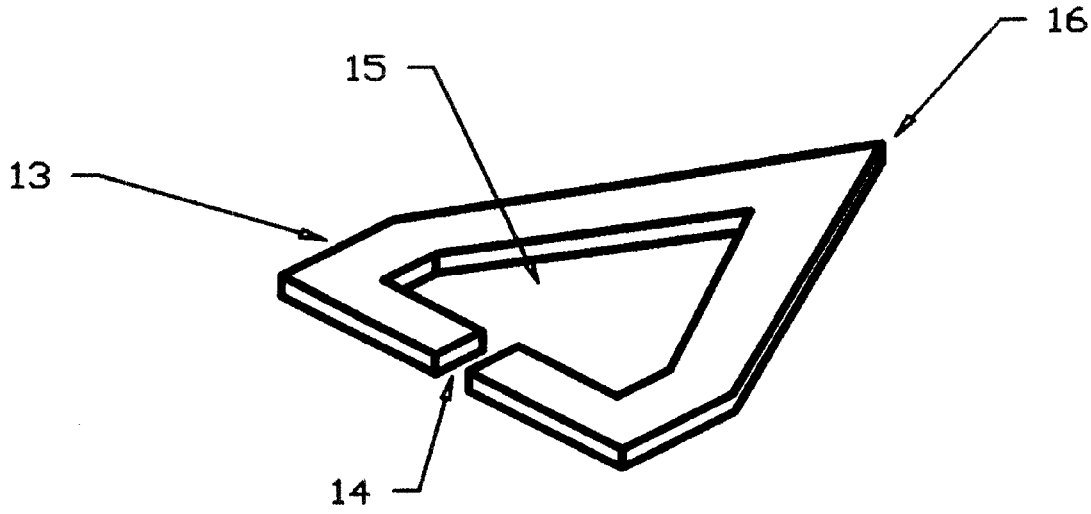
FIG. 2 shows the open flat clip supplied apart from the rolls of tape.

At FIG. 2, we see the open flat clip 13 standing alone with the permanent opening 14, the inside hole 15 and the pointed edge 16.

Figure 3:
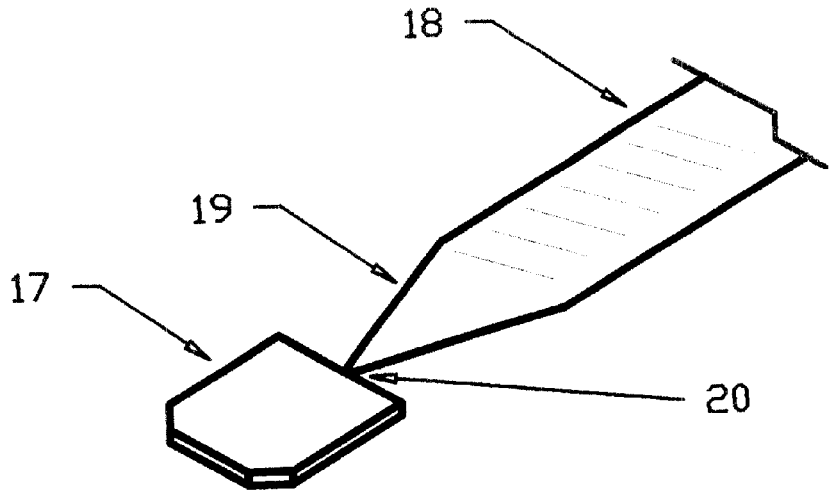
FIG. 3 shows the rigid piece of tape or the rigid piece of cardboard with the tape folded over and adhered to itself, both pieces are the same width as the tape, and the tape being progressively reduced in width from about 25 mm from the rigid piece, to become a cord at the rigid piece itself.

FIG. 3 shows the rigid piece of tape or cardboard 17 with the tape folded over and adhered to itself at the trailing end of the running tape 18. We see the tape being progressively reduced in width 19 from about 25 mm from the rigid piece, to become a cord 20 at the rigid piece itself.

Figure 4:
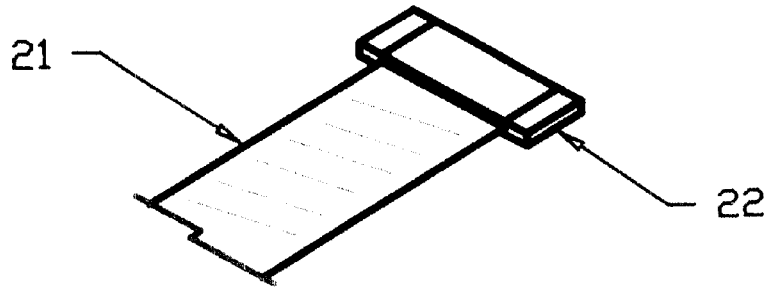
FIG. 4 shows the piece of rigid tape or the cardboard piece with the tape folded over and adhered to itself, positioned at the leading end of the new roll of tape to splice, the rigid piece of tape or cardboard being wider then the width of the tape.

FIG. 4 shows the rigid piece of tape or the piece of cardboard 22 with the tape folded over and adhered to itself located at the leading end of the stand-by roll of tape 21.

Figure 5:
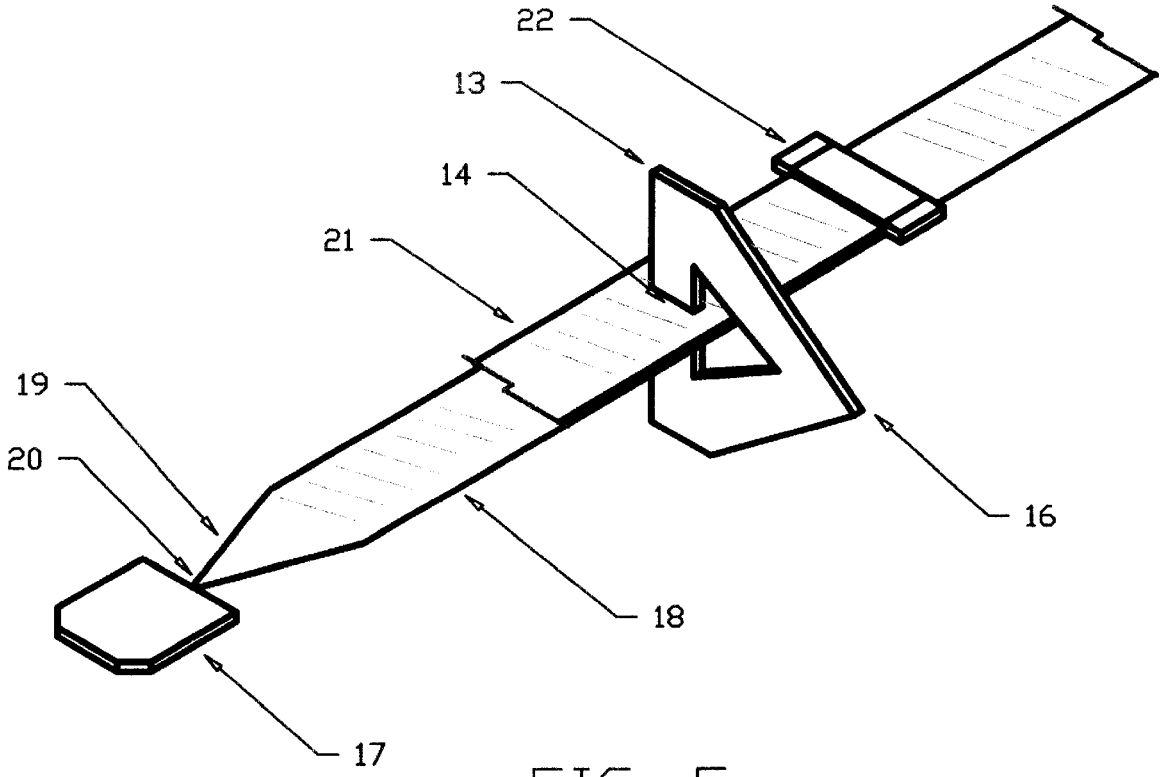
FIG. 5 shows how the tapes are positioned and how they are inserted in the clip by the permanent opening, with the stand-by tape always on the edge of the clip that has the permanent opening.

FIG. 5 shows both the running tape 18 and the stand-by tape 21 positioned close together, at the moment when both tapes are inserted inside the hole of the clip 13 by the permanent opening 14. The pointed edge 16 of the clip is always positioned on the side of the running tape 18 and the flat edge is always close to the rigid piece of tape 22 of the trailing end of the stand-by tape 21.

Figure 6:
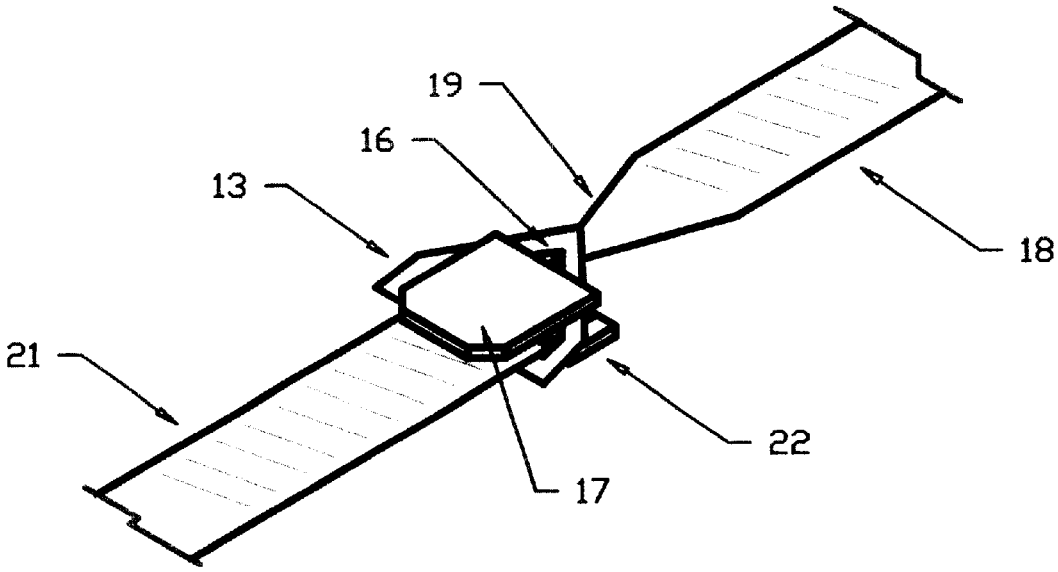
FIG. 6 & 7 shows both end elements connected to the clip at splice time.
Figure 7:
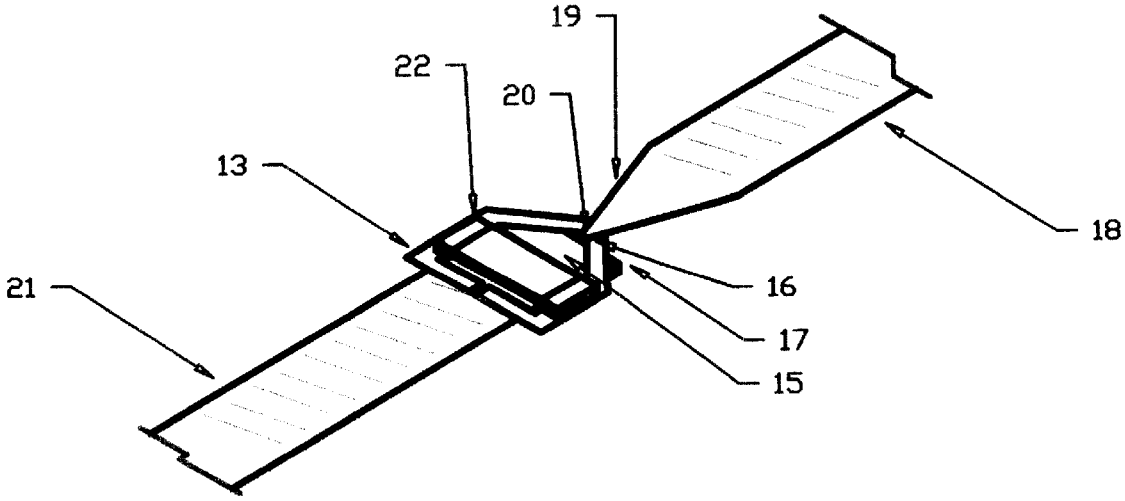

FIG. 6 & 7 shows when the piece of rigid tape or the piece of cardboard 17 at the trailing end of the running roll of tape 18 gets close to the clip, the progressively reduced width of the tape 19 engages the inside pointed edge 16 of the clip. When the piece of rigid tape or cardboard 17 enters in contact with the clip, the front edge of the piece of rigid tape or cardboard 17 gets caught in the pointed edge 16 of the inside hole 15 of the clip, thus connecting the piece of rigid tape or cardboard 17 to the clip at the cord level 20.

The combination of the clip 13 and the piece of the rigid tape or cardboard 17, is carried away by the running tape 18 by the progressively reduced width of the tape 19 and the cord 20, thus connecting the square edge of the clip at the permanent opening level 14 to the piece of rigid tape or piece of cardboard 22 at the leading end of the stand-by tape 21, thus locking the running tape 18, the piece of rigid tape or cardboard 17, the clip 13, the piece of rigid tape or cardboard 22 and the stand-by tape 21, thus splicing both tapes 18 and 21 together.

Having described and illustrated the principles of our invention with reference to a preferred embodiment, it will be apparent to those having skill in the art that the invention can be modified in arrangement and detail without departing from such principles.

In view of these and the wide range of other embodiments to which the concepts of the present invention can be applied, it should be recognized that the foregoing description is illustrative only and is not to be construed as limiting the scope of the invention. Instead, we claim as our invention all such modifications as may come within the scope and spirit of the following claims and equivalents thereof.

I claim:

1. A clip for use in a tape dispensing machine, said machine comprising a running tape having first engagement means at its first extremity and second engagement means at its second extremity and means to hold, in stand-by relationship to said running tape, a stand-by tape having third engagement means at its first extremity and fourth engagement means at its second extremity, said clip having a perimeter defining an open area adapted to surround said running tape and said stand-by tape, an opening in said perimeter through which said running tape and said stand-by tape can be introduced in said open area, and means to engage with said second engagement means and said third engagement means.

2. A clip as claimed in claim 1 wherein said perimeter is generally triangular shaped.

3. A clip as claimed in claim 2 wherein said opening is located in the base of said triangular shape.

4. A clip as claimed in claim 1 wherein said first engagement means and second engagement means are unitary with said running tape and said third engagement means and fourth engagement means are unitary with said stand-by tape.

5. A clip as claimed in claim 1 wherein said third engagement means are attached to said clip.

6. A clip as claimed in claim 1 wherein said third engagement means are unitary with said clip.

7. A splicing apparatus for a tape dispensing machine comprising:

a) a running tape having first engagement means at its extremities, b) a stand-by tape, having second engagement means at its extremities, said stand-by tape being located adjacent to said running tape, c) a clip having an opening to a generally enclosed open portion, said open portion having a running side and a replacement side, whereby said running tape and said stand-by tape are spliced together by said clip with one of said first engagement means of said running tape being connected to said running side of said clip and one of said second engagement means of said stand-by tape being connected to said replacement side of said clip.

8. The apparatus of claim 7, wherein said open portion has a width equal or larger than said first and second engagement means.

9. The apparatus of claim 7, wherein said first and second engagement means and said running and stand-by tapes have the same width.

10. The apparatus of claim 7, wherein said first and second engagement means are wider than said running and stand-by tapes.

11. The apparatus of claim 7, wherein said first and second engagement means are flat.

12. The apparatus of claim 7, wherein said running tape tapers in width to become a cord at said second engagement means.

13. The apparatus of claim 12, wherein the running tape tapers 25 mm before said second engagement means.

14. The apparatus of claim 7, wherein said first and second engagement means are made of folded tape.

15. The apparatus of claim 7, wherein said first and second engagement means are made from a piece of cardboard put transversely to the tape, with said tape folded over and adhered to itself or to said cardboard.

16. The apparatus of claim 7, wherein said clip is flat.

17. The apparatus of claim 7, wherein said running side of said clip's open portion has a pointed form extending towards said running tape.

18. The apparatus of claim 7, wherein said replacing side of said clip's opened portion is parallel to said stand-by tape's width.

19. The apparatus of claim 7, wherein the clip is made of a plastic sheet.

20. The apparatus of claim 19, wherein said plastic sheet is a polycarbonate.

21. The apparatus of claim 7, wherein said running and stand-by tapes are rolled up.

22. A method for splicing tapes in a tape dispensing machine to ensure a continuous supply of tape, comprising the steps of:

a) providing a first running tape with a running direction and first engagement means at both its extremities;

b) positioning a second immobile stand-by tape with a replacement direction and second engagement means at both its extremities, said second tape being adjacent to said first tape and said replacement direction being generally parallel to said running direction;

c) inserting said first and second tape into a generally enclosed open portion of a clip having an opening;

d) having one of said first engagement means of said first running tape connect and drag along said clip, e) having said clip connect with one of said second engagement means of said second tape and drag it along.

* * * * *